United States Patent [19]

Bradley

[11] 4,054,091

[45] Oct. 18, 1977

[54] SILK SCREEN PRINTING PROCESS AND APPARATUS

[75] Inventor: Robert F. Bradley, New Buffalo, Mich.

[73] Assignee: Micro-Circuits Company, Inc., New Buffalo, Mich.

[21] Appl. No.: 673,956

[22] Filed: Apr. 5, 1976

[51] Int. Cl.[2] ..... B41F 15/04; B41F 15/10

[52] U.S. Cl. ..... 101/129; 101/115; 101/123; 209/347

[58] Field of Search ..... 101/114, 115, 123, 126, 101/129; 118/213, 247; 209/346, 347, 381-382, 385, 389, 369

[56] References Cited

U.S. PATENT DOCUMENTS

| | | | |
|---|---|---|---|
| 1,179,106 | 4/1916 | Iwajiro | 101/114 |
| 1,904,032 | 4/1933 | Roberts | 209/347 |
| 2,034,003 | 3/1936 | Shurley | 101/126 X |
| 2,176,187 | 10/1939 | Perry | 101/129 X |
| 2,966,844 | 1/1961 | Laupman | 101/123 |
| 2,968,239 | 1/1961 | Zumbehl | 101/123 |
| 3,018,724 | 1/1962 | Nash | 101/115 X |
| 3,180,256 | 4/1965 | Kramer et al. | 101/129 |
| 3,217,881 | 11/1965 | Wehner | 209/347 X |
| 3,218,967 | 11/1965 | Childress | 101/114 |
| 3,403,622 | 10/1968 | Moser et al. | 101/126 |
| 3,536,005 | 10/1970 | Derrickson | 101/115 X |
| 3,589,284 | 6/1971 | Harwell Jr. | 101/115 X |
| 3,744,412 | 7/1973 | Grue et al. | 101/114 |
| 3,902,414 | 9/1975 | Zimmer et al. | 101/126 X |

FOREIGN PATENT DOCUMENTS

| | | | |
|---|---|---|---|
| 1,175,156 | 3/1957 | France | 101/114 |
| 2,143,137 | 3/1973 | Germany | 101/126 |

*Primary Examiner*—Edgar S. Burr
*Assistant Examiner*—R. E. Suter
*Attorney, Agent, or Firm*—Marmaduke A. Hobbs

[57] ABSTRACT

A silk screen printing process and apparatus in which a silk screen having a porous figure printing area may be divided by partitions into compartments for different types or colors of ink. The printing operation is performed by a rapid upward acceleration of the silk screen and sheet on which the printing is to be performed, thereby causing the ink to flow through the porous printing area of the screen as a result of inertia. Various types of apparatus may be used to perform the process, one consisting of a platen on which the sheet and silk screen are placed, and a hammer type element which strikes the underside of the platen to produce the upward acceleration. Another type of apparatus prints a continuous sheet of material, and as the sheet material moves along the underside of the silk screen, the sheet is pressed upwardly against the underside of the screen, thereby producing an upward acceleration in the form of a rippling effect which causes the ink to flow from the various compartments through the porous figure printing area onto the adjacent surface of the sheet. The continuous operation may be performed by a plurality of blades mounted on a belt beneath the silk screen. Devices for maintaining the ink in the various compartments at a substantially constant level may be provided in either of the two types of apparatus mentioned hereinabove.

16 Claims, 9 Drawing Figures

Fig. 1
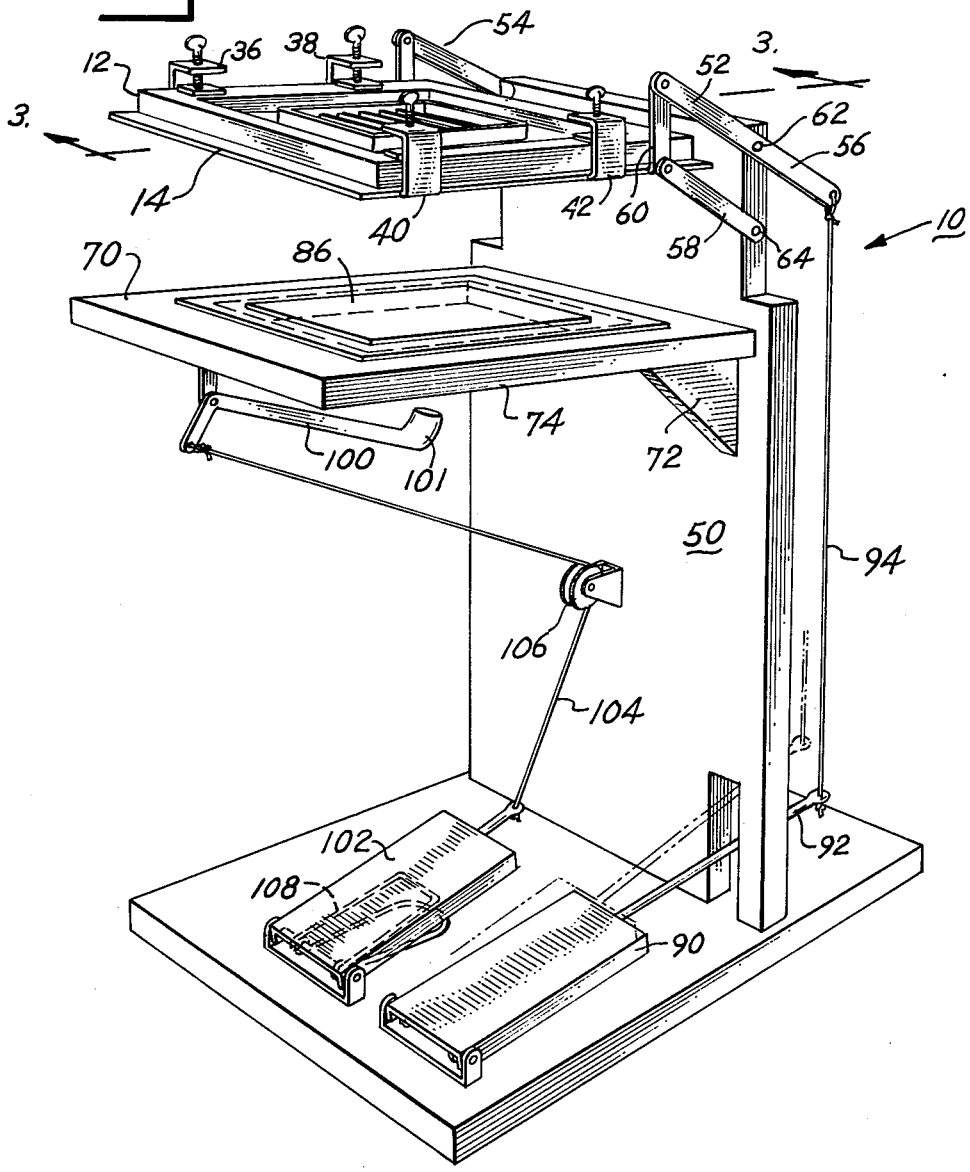
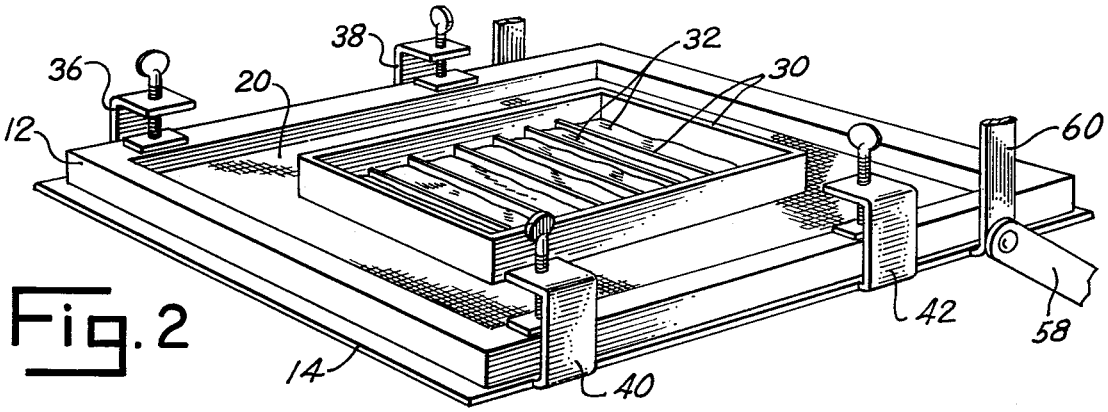
Fig. 2

SILK SCREEN PRINTING PROCESS AND APPARATUS

In the conventional silk screen printing process and system, the sheet or other material to be printed is placed beneath the screen and the ink is placed on the silk screen and pressed through the porous figure printing area by a squeegee or the like operated from above. The ink is normally of a consistency that it will not flow through the porous area of the screen without being pressed therethrough by the squeegee or similar device. After the printing operation has been performed, the paper or other material on which the figure is printed is removed from the underside of the screen and another sheet is placed beneath the screen for repeating the foregoing operation. The operation may be a separate sheet operation or a continuous sheet operation. One of the big disadvantages of the silk screen operation is the difficulty of multiple ink printing. The operation normally followed in the multiple ink process consists of separate operations for each ink through successive silk screens, with a silk screen for each individual ink applied to the material printed. This type of operation is not only time consuming but expensive, in that separate silk screens are normally required to perform the various successive operations. It is therefore one of the principal objects of the present invention to provide a process and apparatus for multiple ink silk screen printing in which only one silk screen and one operation are required to complete the multiple ink printing operation.

Another object of the present invention is to provide a relatively simple apparatus which will perform the multiple ink silk screen printing operation and which will perform the complete operation in a single step or operation. A still further object of the present invention is to provide an apparatus which will perform a multiple ink silk screen operation in a continuous manner with a strip of material utilizing the foregoing novel process.

Additional objects and advantages of the present invention will become apparent from the following description and accompanying drawings. The invention relates basically to a process and equipment which permit the application of inks of various colors and/or of inks of different conductive, adhesive, protective and/or resistive properties, simultaneously to accomplish the foregoing objects. The process may be performed by a number of different types of apparatus, consisting of either a simple structure or sophisticated equipment. The present process and apparatus have wide application and may be used to print a variety of different types of material, including circuit boards, cards for security locks, multiple color greeting cards, advertising displays and point-of-sale containers, and business and computer technology forms. Unless otherwise indicated, when the word "sheet" is used in the specification and claims, it refers to any and all materials, forms and shapes capable of being printed by my process. As mentioned above, "ink" refers to any flowable liquid or powder which may be controlled by the process, and "silk screen printing" refers to a generally understood method for repeatably applying coatings on suitable surfaces. It is not limited to the use of silk cloth or to particular coating materials now available.

The process is suitable for a wide range of magnetic, capacitative, resistive and inductive printing applications, and an example of its use in printing a circuit board should assist in a fuller understanding of the invention. In the example, a silk or metal screen is masked with openings for all of the resistors and conductors required in the final circuit. Each resistor opening will be of proper shape to yield the proper resistance value when the proper ink is applied through it. Continuous with the resistor openings will be openings for silver or low resistance ink which will form terminals, and "wires" linking the resistors with etched copper areas or with connections external to the circuit.

The screen is placed in a horizontal position during use, and attached to its upper surface is a series of vertical dividers forming separate compartments into which inks of different resistance-value are poured. The design is such that each different ink will be over the screen openings required to deposit the proper resistors on the circuit board. Ideally the circuit will be laid out in such a way that only one compartment of each different ink will be required, but this is not essential. The bottoms of the dividers are in contact with the screen surface except where the screen openings for resistors and conductors meet. At such points the divider is raised slightly so that the two inks will merge under the divider. However, ink consistency is such that, when poured into its compartment, it will not flow down through the screen openings due to gravity alone. A horizontal platen or table is disposed beneath the screen with provision for positioning each circuit board to be printed thereon. After a circuit board is placed on the platen, the screen is lowered so that the top surface of the circuit board makes contact with the underside of the screen. At this time the platen is given a relatively hard upward impact to force ink down through the screen and onto the surface of the printed circuit board, using the effect of inertia to deposit the various inks simultaneously on the board. The screen is then immediately raised above the platen. The platen can simply be moved up to strike the underside of the screen to transfer the ink, but the intensity of the impact may be a useful way to vary the amount of ink transferred just as squeegee pressure and number of passes control the amount and repeatability of ink transfer in conventional silk screening. At one end a resistor area may overlap an etched copper member and at the other end may join with a silver or low resistance ink terminal applied with it. Resistors, regardless of resistance value, may be of a small size or large enough to dissipate substantial wattage. A low resistance ink may be used as terminals and wires for high resistance resistors. To provide enough ink transfer to coat the walls of holes designed to carry the circuit from one side of the board to the other, it may be necessary to make holes in the screen over the holes in the circuit board.

As indicated hereinabove, the same technique as described more fully below, may be used to make multicolor decorative pictures and impressions. The process and equipment described are not related to an occasionally-used conventional silk screen technique in which several colors of ink are squeegeed across a screen in one stroke. The system to which the present invention relates confines each ink to its own area of the screen and it transfers the ink to the circuit board sheet or other material to be printed by inertia or percussion rather than by the conventional action of a squeegee.

FIG. 1 is a perspective view of an apparatus embodying the present invention, showing it in position preparatory to printing, using my silk screen process;

FIG. 2 is an enlarged view of the apparatus shown in FIG. 1, showing the silk screen mounted therein;

Figure 3:
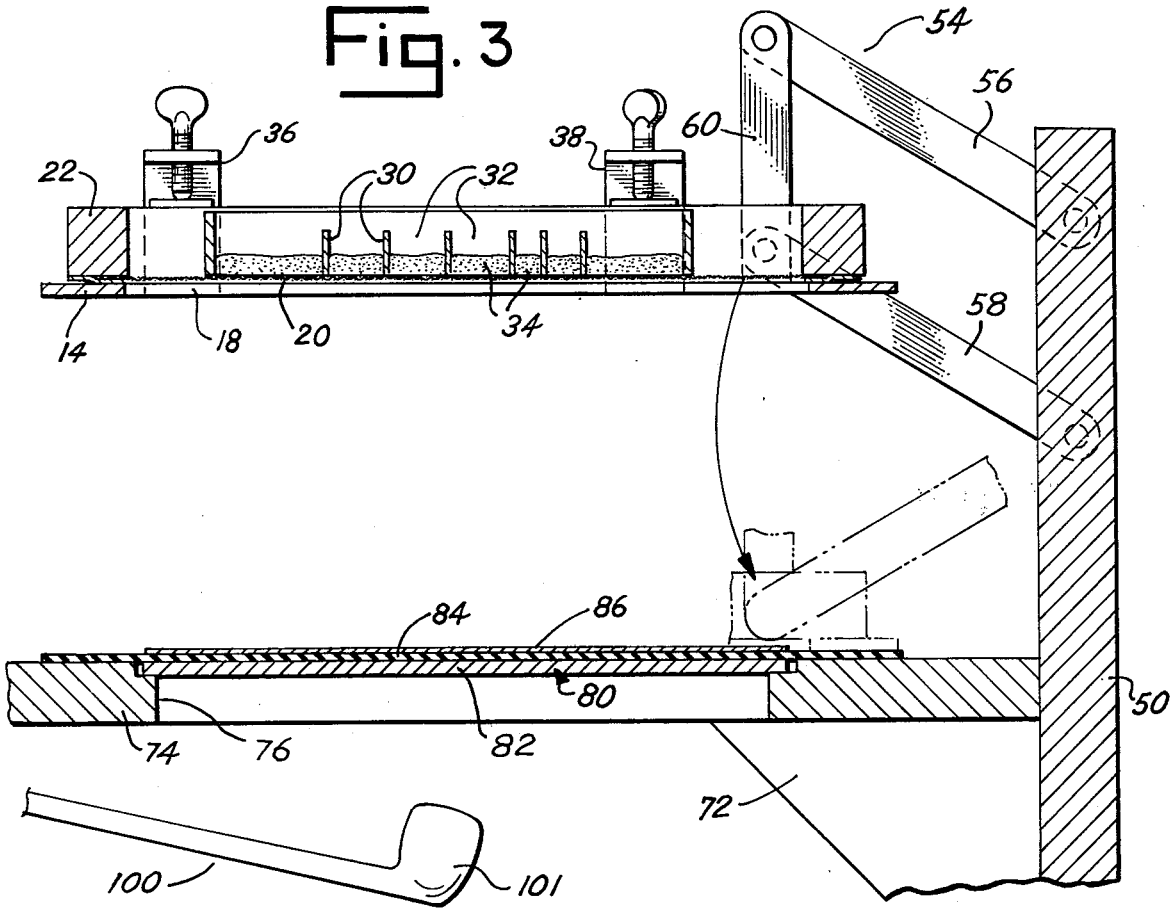
FIG. 3 is a fragmentary vertical cross sectional view taken on line 3 — 3 of FIG. 1, showing the parts of the apparatus in non-operating position.

Referring more specifically to the drawings, and to FIG. 1 in particular, numeral 10 indicates generally a printing apparatus embodying the present invention, showing the apparatus in inoperative or open position preparatory to performing the operation using the process of the present invention. The type of apparatus used in FIG. 1 performs the printing operation, using a plurality of different inks to print single sheets introduced individually into the apparatus. While the individual sheet type of printing illustrated in FIG. 1 is suitable for limited operations, the present concept is applicable to a continuous operation such as that illustrated in the apparatus shown in FIG. 5. Various types of apparatus can be employed to utilize the present inertia or acceleration concept for printing with either one or more different inks simultaneously on a single sheet or area. The inks may be merely different colored inks or they may be inks or fluid, including powders, having different physical properties or characteristics, such as different electrical conductivity. The work "inks" when used herein is intended to include any and all flowable substances capable of being used with the apparatus and method, unless otherwise indicated.

Apparatus 10 includes a silk screen unit 12 of a rectangular shape mounted on a rectangular frame 14 having a rectangular center opening 18, thereby exposing the underside of the silk screen 20 which is supported by rectangular frame 22 forming the periphery of the silk screen unit. The silk screen 20 for the purpose of the present invention may be considered essentially a conventional type silk screen with the silk screen being impervious except where the design to be printed is left porous in the form of the design of the figure to be printed. In the usual silk screen operation, where a single ink is used in the printing operation, a squeegee or accelerator bar or similar device is used to force the ink through the porous part of the silk screen onto the paper or material to be printed. However, this type of operation is normally limited to one kind of ink in any single operation, repeat operations being required where multiple colors or properties are used.

In the present invention, the silk screen unit includes a plurality of partitions, indicated generally by numeral 30, which divide the figure printing area into a plurality of compartments 32 for different colors or types of ink indicated generally by numeral 34. The partitions may be of metal, wood or plastic and are normally seated firmly on the upper side of silk screen 20 with sufficient adhesion to the upper surface of the silk screen that the ink in one compartment is prevented from flowing into or mixing with the ink in the adjacent compartments. It may be desirable in some instance to cement or otherwise secure the lower edge of the partitions to the upper surface of the screen to form a positive seal between the compartments at the lower edge of the partitions. Thus, the partitions define a plurality of areas in the overall figure printing area which will receive the various colors or types of inks. The silk screen unit 12 is, of course, different for each particular figure.

In order to facilitate substitution of the silk screen units in the apparatus, the units are removably secured to frame 14 by clamps 36 and 38 on one end and 40 and 42 on the other end of frame 14. Other types of clamping means may be used, provided they permit easy substitution of one silk screen unit for another. Frame 14 is supported by a post or back 50 by pivoted brackets 52 and 54 on opposite sides of the frame, each bracket having an upper bar 56 and a lower bar 58 connected to one another at the forward end by a vertical bar 60, the bars being pivoted to the upper end of post 50 by pins 62 and 64. The two pivoted brackets permit the frame and silk screen unit to be moved downwardly during the operation of the apparatus. A fixed platen assembly 70 is supported on post 50 by fixtures 72, the assembly including a rectangular frame 74 having a rectangular opening 76 therethrough and a platen 80 mounted over said opening. The platen consists of a rigid plate 82 and preferably a resilient cover 84 on which the sheet 86 of paper or other material, or a circuit board, to be printed is placed when the printing operation is performed. The frame 14 and silk screen unit 12 are lowered from the position shown in FIG. 3 to the position shown in FIG. 4 after a sheet of paper or other material to be printed has been placed on the platen. In this embodiment the silk screen rests on the sheet 86; however, the ink is of such consistency that it will not, of its own weight, flow through the figure printing area onto the silk screen by mere contact of the silk screen with the paper. The movement of frame 14 between the two positions is performed preferably by a pedal 90 connected to bar 56 by rods 92 and 94. Thus, when the pedal is moved from the position shown in full lines to the position shown in broken lines under the influence of gravity on frame 14, the frame is moved to the printing position shown in FIG. 4, with the silk screen resting on the material to be printed.

In the operation, the actual printing is performed by inertia when a hammer 100 is operated to strike the underside of platen 80. As the hammer strikes the underside of the platen, a momentary upward force is applied to the platen and to the silk screen. Thus, the inertia of the ink or acceleration of the screen causes the inks in the various compartments to flow downwardly through the printing areas onto the upper surface of sheet 86, thereby printing the figure with the various inks on the sheet. After the platen has been struck by hammer 100, the pedal 90 is pressed downwardly, thus raising frame 14 and silk screen unit 12 from the position shown in FIG. 4 to the position shown in FIG. 3, thus permitting the printed sheet to be removed from the platen or from the underside of the silk screen. The hammer is operated by a pedal 102 connected to the outer end of the hammer by a cable 104 trained on a pulley 106 supported by post 50. A spring 108 beneath the pedal returns the pedal to its upper position and the hammer to its downward position where it is withdrawn from the underside of the platen. The hammer is operated by pressing down on pedal 102, causing cable 104 to move hammer head 101 forcefully against the underside of the platen. In the embodiment shown, no provision is shown for removing the sheet from the silk screen; hence, it would be peeled from the underside of the screen. A vacuum admitted through a series of holes in the platen may be used to hold the paper or other material on the platen as the silk screen unit is lifted from the platen, thereby leaving the sheet on the platen where it can be easily removed from the apparatus.

Figure 7:
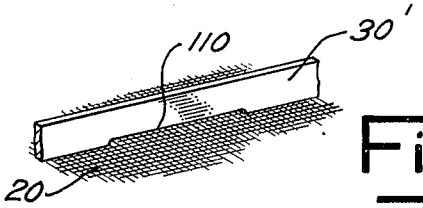
FIG. 7 is a fragmentary view of a partition such as those shown in FIG. 6 wherein provision is made for flowing the ink from one compartment to the other to eliminate any space between the printed portions of two adjacent ink compartments on the silk screen.

The printing operation using multiple inks is effectively performed by first restricting the inks to the various compartments and producing an inertia reaction between the ink and the silk screen and paper so that the ink will flow through the figure printing area of the silk screen onto the paper, without the use of a squeegee and without performing separate operations on the ink in the various compartments. This inertia reaction permits the compartments to be of various configurations and sizes and permits the use of a relatively large number of different inks to obtain the desired type of printing, such as a circuit board with the various components printed thereon, or signs, posters and the like with inks of appropriate colors and physical properties. FIG. 7 illustrates a partition 30' having a slot 110 therein which permits the ink of one compartment to flow into contact with the ink of the other compartment. The slot must be sufficiently small and the ink of sufficient viscosity to prevent any significant intermixing of the inks at the point of juncture in the slot.

Figure 4:
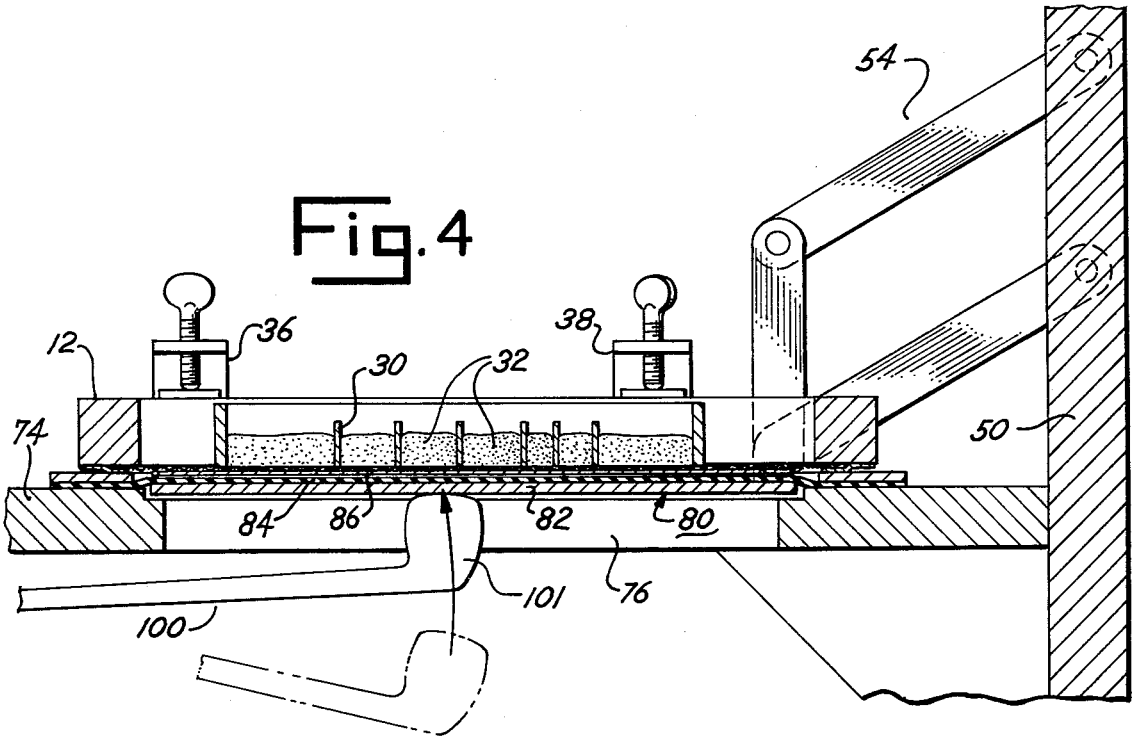
FIG. 4 is a cross sectional view similar to that shown in FIG. 3, but showing the apparatus in the position in which the printing operation is performed.

In the operation of the apparatus shown in FIGS. 1 through 4, a sheet of paper is placed on the platen and the pressure on pedal 90 holding frame 14 and the silk screen assembly in its elevated position is released, thus permitting the frame and silk screen unit to move down to the position shown in FIG. 4, with the bottom of the silk screen in contact with the paper. With the parts in this position, pedal 102 is pressed rapidly downwardly, pivoting hammer 100 upwardly and causing head 101 to strike the bottom side of the platen. The rapid upward force resulting from the platen being struck by the hammer causes the ink in the figure printing area to pass through the unmasked portion of the silk screen and to be deposited on the upper surface of the paper. Normally one strike of the hammer is all that is required to perform the operation and apply the ink to the paper. Pedal 90 is then depressed, thereby lifting the frame 14 and the silk screen unit upwardly to the position shown in FIGS. 1 and 3. The printed sheet is then removed and another sheet is placed in the apparatus for repeating the foregoing operation. While a sheet of paper has been referred to herein in this operation, the apparatus can be used effectively for printing circuit boards, cardboard or other stiff material in the same manner.

Figure 5:
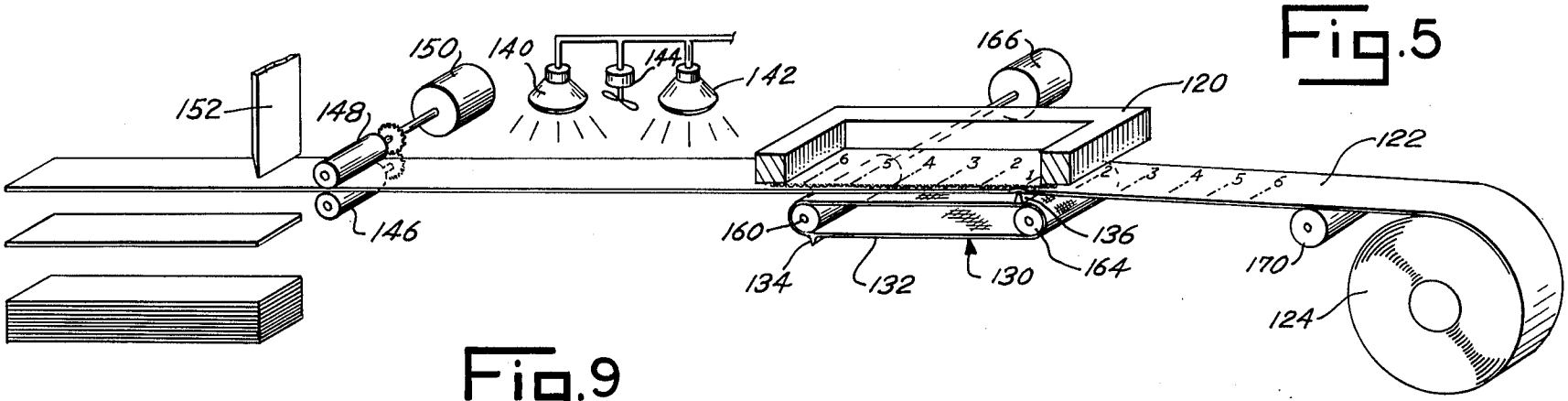
FIG. 5 is a schematic view of an apparatus relating to the continuous printing of a strip of material by my process.
Figure 9:
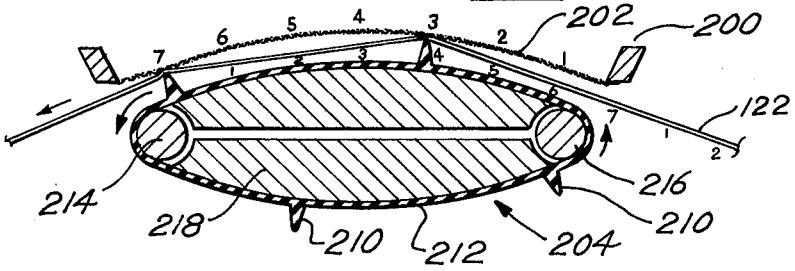
FIG. 9 is a schematic view of a modified form of the apparatus shown in FIG. 5.
Figure 6:
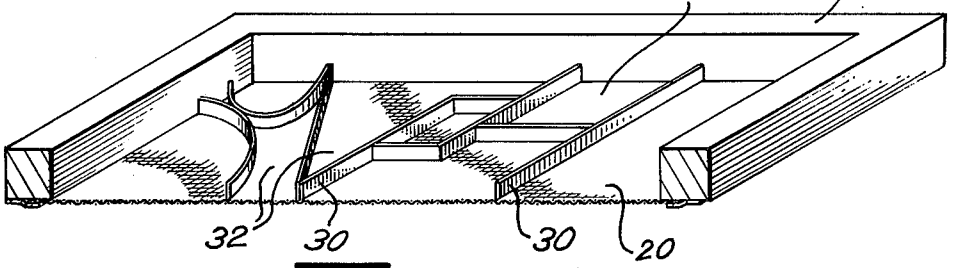
FIG. 6 is an enlarged fragmentary cross sectional view of a silk screen and auxiliary parts thereof, which may be used in the present process to print with a number of different inks in a single operation.

In the embodiment of the invention illustrated in FIGS. 5 and 9, the concept is essentially the same as that shown in the embodiment of FIG. 1; however, the process is continuous, and the inertia is created by acceleration of the ink mass as a continuous strip of material is passed beneath the silk screen. In this embodiment, the acceleration of the ink mass in the various compartments similar to those previously described is produced by movement of a relatively sharp edged blade under the screen and paper so that the mass of ink in the compartments is accelerated upwardly as the edge of the blade passes thereunder. This is done by using a silk screen similar to that shown in the previous embodiment, with the screen assembly 120 positioned above the strip of paper 122 unwound from roll 124. The strip of paper is raised into contact with the underside of the screen by a mechanism indicated generally by numeral 130 consisting of a belt 132 with one or more squeegee or accelerator bar-like members 134 and 136 thereon. The smooth corner of the squeegee or accelerator bar, which may be of rubber or metal, pushes upwardly against the underside of the paper near one edge thereof and presses the paper against the screen, slightly raising the paper directly above the edge of the squeegee or accelerator bar into contact with the screen. The edge of the squeegee or accelerator bar is then slid rapidly across to the opposite parallel side of the paper so that it causes a small ripple or wave in the ink above the screen. The paper, screen and ink are briefly accelerated upwardly as the squeegee or accelerator bar passes under each part. As a result of inertia, the ink tends to resist the upward acceleration by passing downwardly through the figure printing area of the screen. The paper passes from the silk screen unit to an area in which heat is applied by lamps 140 and 142 and air is applied by a blower 144 to dry the ink before it passes through drive rollers 146 and 148 driven by motor 150 which controls the unwinding of paper from roll 124. After the paper passes through the drive rollers, it may be cut into individual sheets by a cutter schematically shown at numeral 152.

The foregoing continuous operation involves a technique which permits the effective and correct printing to take place while the strip of paper is moving. The two squeegees or accelerator bars 134 and 136, which are mounted on belt 132, which in turn is stressed between two drive rollers 160 and 164 driven by motor 166, cause the squeegees or accelerator bars to move along the underside of the paper. As one squeegee or accelerator bar sweeps along the underside of the screen from the right to left, forcing a thin line or ripple of the paper strip upwardly against the underside of the screen, the other accelerator bar is moving to the right to be ready for the next printing impression.

The paper moves to the left twice the speed of the accelerator bar. The operation of the printer can be understood by reference to numbers rising in value from 1 to 6 on the left on the screen and rising from 1 to 6 on the right on the paper which is about to pass beneath the silk screen assembly from right to left. Number 1 is common to both series of numbers. As accelerator bar 136 moves from 1 to 2 on the screen, the point 2 on the paper moves twice as fast and twice as far to arrive at point 2 on the screen at the same time as the accelerator bar edge. In the same way, the last point 6 on the paper also moves twice as fast as the accelerator bar so that it arrives under point 6 on the screen at the same time as the accelerator bar. The printed impression which emerges from the left side of the press assembly is the image on the screen but reversed from left to right. If a different color of ink were placed at each number, for example, such as in separate compartments as described in FIG. 1 with reference to the previous embodiment herein on the screen, then the printing impression would have six different colors as defined in the screen mask.

Since the line of contact between the drive rollers 146 and 148 and the top positioning roller 170 is placed to hold the plane of the paper below the plane of the bottom of the screen, the paper is raised by the operating accelerator bar so that it makes only a line contact with the underside of the screen. There may be an insignificant constant smear on the paper, since the paper moves to the left while the screen does not move; however, this only results in a slight lengthening of each detail and is a small fraction of an inch determined by the radius or sharpness of the edge of the accelerator bar. This minor distortion can be corrected if necessary by the nature of the figure on the silk screen. When one accelerator bar completes its impression, the other accelerator bar is ready to move into position to make the next impression as the paper moves continuously.

Figure 8:
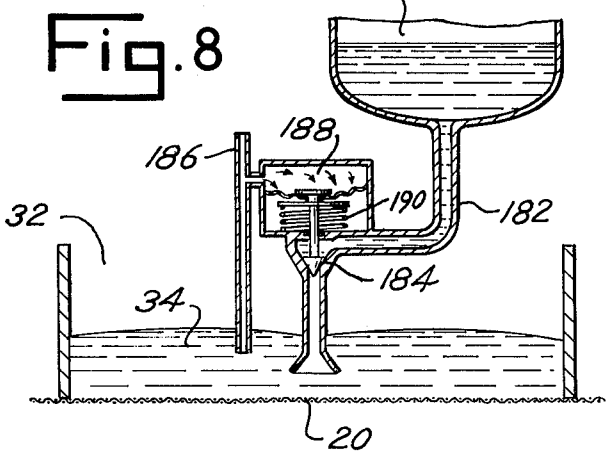
FIG. 8 is a vertical cross sectional view through an ink supply device which maintains the ink level in a compartment such as shown in FIG. 6, at a substantially constant level.

Various devices or systems may be used to feed ink to the compartments in the silk screen unit. A system is illustrated in FIG. 8 consisting of a reservoir 180 and a tube 182 having a control valve 184 therein. The valve mechanism maintains a constant ink level. The valve is controlled by air pressure introduced into tube 186 which enters chamber 188 and urges the valve toward closed position in opposition to spring 190. The pressure builds up in chamber 188 whenever the low open end of tube 186 is covered by the ink in compartment 32. When the level of the ink falls below the lower end of tube 186, the pressure in chamber 188 falls, thus permitting spring 190 to open the valve and permit the flow of ink into the chamber until the level has raised sufficiently to close the lower end of tube 186. These units can be used for each of the compartments, thus providing a substantially constant level above the screen.

The embodiments of the present apparatus shown in FIG. 9 is basically the same as that shown in FIG. 5 and involves the printing on the continuous strip of material. Like numerals will be given to like parts where applicable. Silk screen unit 200, having silk screen 202 therein, is in an arcuate configuration with strip 122 passing between the screen and a force supplying unit 204. The curvature of the screen paper and the rollers 146, 148 and 170 hold the plane of the sheet well below the under surface of the screen, except at the point at which the printing is taking place. The sheet is raised by the edge of the inertia or accelerator bars 210 disposed in equally spaced relation on a belt 212, the belt being trained on rollers 214 and 216 and held in arcuate configuration by internal support member 218. The sheet is raised by the edge of the accelerator bars 210 so that it makes only a line contact on the underside of the screen, the bars producing a rippling effect at the point of contact. Since the sheet moves to the left while the screen does not move, there will be a constant smear of the image deposited on the paper but, because of the very small radius of the edge of the bars, the smearing results in an insignificant lengthening of each detail in the direction of the movement of the sheet. As mentioned previously herein, with reference to the embodiment of FIG. 5, this slight distortion can be compensated for by slight alterations in the image placed on the silk screen for printing the sheet.

As in the embodiment of FIG. 5, at the start of the impression, with the sheet being drawn through the apparatus toward the left, point 1 on the paper will be directly under point 1 on the screen and will be pressed against the underside of the screen by one of the accelerator bars 210 which has just rotated upwardly to begin its travel to the left on the underside of the sheet.

A given point, such as numeral 1 on the sheet, moves twice as fast lineraly to the left as the bar, so that by the time the edge of the bar has moved from 1 on the screen to 7 on the screen, the point 7 on the paper will have also reached point 7 on the screen. Points 2, 3 etc. on the paper will reach the corresponding point on the screen at the same time that the respective bar passes under. Thus, when the impression area 1 through 7 on the paper leaves the screen at the left, it will be a reverse image of the unmasked area on the screen, and if a different color of ink is placed at each of the numbers, which represent separate compartments on the screen, the printed impression will have seven different colors thereon. The numbers 1 through 7 are used only for the purpose of explaining the invention and do not necessarily represent structural features or areas on either the screen or the paper.

As one accelerator bar sweeps along the underside of the paper from right to left, it forces the paper and screen upwardly in a think wave or ripple. Due to the inertia, the inks which are otherwise prevented from flowing downwardly through the screen by their viscosity and thixotropy, are forced by inertia through the porous image on the screen onto the upper surface of the paper at the proper time to start the next impression on the succeeding section of the continuous strip of paper. The next accelerator bar rises around the right hand end of unit 204 and makes contact with the paper strip, forcing it into contact with the screen, with point 1 on the paper being in contact with 1 on the screen and with the paper moving twice the speed of the accelerator bar as each corresponding point on the paper reaches the corresponding point on the screen as the accelerator bar sweeps beneath the paper, as previously described herein.

While only two or three embodiments of the present silk screen printing apparatus and method have been described herein, various changes and modifications may be made without departing from the scope of the invention.

I claim:

1. A silk screen printing process for printing with a plurality of different inks in a single operation, said process comprising forming a screen with ink porous areas therein representing the figure to be printed and with partitions separating said areas into compartments for the different inks, positioning a sheet to be printed beneath the screen and applying an upwardly accelerating force to said sheet and screen to cause the inks to flow through the respective areas from the compartments onto the surface of the sheet.

2. A silk screen printing process as defined in claim 1 in which the upwardly accelerating force consists of a sharp blow to said sheet and screen to cause rapid acceleration thereof and resulting in a simultaneous flow of said inks through the screen onto the paper by the inertia.

3. A silk screen printing process as defined in claim 1 in which said upward accelerating force is applied by a rapid rippling effect progressively from one end of the screen figure to the other end thereof.

4. A silk screen printing process as defined in claim 2 in which said sheet is supported by a rigid platen and said upwardly accelerating force moves said platen relative to the inks in said compartments to cause the inks to be deposited on the upper surface of said sheet.

5. A silk screen printing process as defined in claim 4 in which said sheets are individual sheets placed between said screen and platen.

6. A silk screen printing process as defined in claim 3 in which said sheet to be printed is a continuous sheet which moves along the underside of said screen as said rippling action is performed.

7. A silk screen printing process as defined in claim 6 in which said continuous sheet moves from one end of the screen to the other at a rate twice that of the rippling action causing the upward accelerating force.

8. An apparatus for printing with a silk screen using a plurality of different inks in a single operation, comprising a screen having ink porous areas therein representing the figure to be printed, means for holding the screen in a horizontal position, partitions in contact with the upper surface of the screen defining separate compartments for the different inks, a sheet receiving means beneath said screen, and means for propelling a sheet to be printed and screen upwardly to cause the inks to flow through the porous areas within the confines of the respective partitions.

9. An apparatus for printing with a silk screen using a plurality of different inks as defined in claim 8 in which an opening is provided beneath at least one of said partitions to permit the inks in the adjacent compartments to contact one another at the partition.

10. An apparatus for printing with a silk screen using a plurality of different inks as defined in claim 8 in which a rigid platen is provided for receiving said sheet, and said platen and said screen are moveable relative to one another to hold said sheet therebetween for printing.

11. An apparatus for printing with a silk screen using a plurality of different inks as defined in claim 8 in which said means for propelling said sheet and screen upwardly consist of a head and a means for moving said head rapidly to produce a sharp blow on the underside of said platen.

12. An apparatus for printing with a silk screen using a plurality of different inks as defined in claim 8 in which said means for propelling said sheet and screen upwardly consists of a blade moveable from a point near one end of the screen to a point near the other end of the screen.

13. An apparatus for printing with a silk screen using a plurality of different inks as defined in claim 8 in which a means for propelling said sheet and screen upwardly consists of a plurality of blades moveable from a point near one end of the screen to a point near the other end of the screen, and said blades are disposed on a driven belt for engaging and moving along the underside of the sheet as it moved between said blades and the underside of said screen.

14. An apparatus for printing with a silk screen using a plurality of different inks simultaneously as defined in claim 8 in which said partitions are secured to the upper side of said screen.

15. An apparatus for printing with a silk screen using a plurality of different inks simultaneously as defined in claim 12 in which said screen is in an arcuate shape and said blades travel in an arcuate path beneath said screen to press the sheet into contact with the underside of the screen when propelling said sheet and screen upwardly to deposit the inks by a rippling effect onto the upper surface of said sheet.

16. An apparatus for printing with a silk screen as defined in claim 8 in which there is included a device for each of said compartments for maintaining the ink in the respective compartments at a substantially constant level.

* * * * *